US006397440B1

(12) United States Patent
Sack et al.

(10) Patent No.: US 6,397,440 B1
(45) Date of Patent: Jun. 4, 2002

(54) ASSEMBLY OF A BUCKLE MECHANISM AND A BLADE AND A METHOD OF SECURING AND RELEASING THE BLADE TO THE BUCKLE MECHANISM

(75) Inventors: James A. Sack, Elverson; Glenn E. Gehr, New Holland; Arthur L. Gehr, East Earl, all of PA (US)

(73) Assignee: Wonderland Nursery Goods Co., Ltd., Taipei (TW)

( * ) Notice: Subject to any disclaimer, the term of this patent is extended or adjusted under 35 U.S.C. 154(b) by 0 days.

(21) Appl. No.: 09/544,203

(22) Filed: Apr. 7, 2000

Related U.S. Application Data

(60) Provisional application No. 60/128,048, filed on Apr. 7, 1999.

(51) Int. Cl.[7] ..... A44B 11/25

(52) U.S. Cl. ..... 24/647; 24/644; 24/637; 24/638

(58) Field of Search ..... 24/637, 638, 644, 24/647

(56) References Cited

U.S. PATENT DOCUMENTS

| | | | | | |
|---|---|---|---|---|---|
| 2,965,942 | A | * | 12/1960 | Carter | 24/644 X |
| 3,189,966 | A | * | 6/1965 | Craven | 24/637 |
| 3,217,370 | A | | 11/1965 | Sharpsteen et al. | |
| 3,226,791 | A | * | 1/1966 | Carter | 24/644 |
| 3,256,576 | A | | 6/1966 | Klove, Jr. et al. | |
| 3,353,234 | A | | 11/1967 | Settimi | |
| 3,364,531 | A | * | 1/1968 | Moss | 24/637 |
| 3,370,329 | A | * | 2/1968 | Takezo Takada | 24/644 |
| RE26,754 | E | * | 1/1970 | Fisher | 24/637 |

* cited by examiner

*Primary Examiner*—Anthony Knight
*Assistant Examiner*—Ruth C. Rodriguez
(74) *Attorney, Agent, or Firm*—Hogan & Hartson, LLP

(57) ABSTRACT

An assembly of a buckle mechanism and blade. The buckle mechanism includes a housing surrounding a guide supported by a base. The guide engages a fastening surface of the blade with the lock surface of a projection of the base and has at least one wall defining a void, which is positionable in a first position so that the projection occupies at least a portion of the void and a second position so that the projection is disengaged from the void. The base has a surface and a projection extending away from the surface. A biasing member locates the guide to a first position in which the blade engages the projection and opposes movement of the guide to a second position in which the blade disengages from the projection. The blade is secured to and released from the buckle mechanism by inserting the blade into the guide; engaging the fastening surface of the blade with the lock surface of the projection; moving the fastening surface of the blade by the guide in a first direction substantially oblique to the planar surface to disengage the fastening surface of the blade from the lock surface of the projection; and removing the blade from the guide in a second direction substantially parallel to the planar surface of the base.

29 Claims, 3 Drawing Sheets

ASSEMBLY OF A BUCKLE MECHANISM AND A BLADE AND A METHOD OF SECURING AND RELEASING THE BLADE TO THE BUCKLE MECHANISM

REFERENCE TO RELATED APPLICATION AND PRIORITY CLAIM

This application expressly claims the benefit of earlier filing date and right of priority from the following patent application: U.S. Provisional Application Serial No. 60/128,048, filed on Apr. 7, 1999 in the names of James A. Sack and Glenn E. Gehr and entitled "Fixed Latch Buckle Mechanism". The entirety of that earlier-filed, co-pending provisional patent application is hereby expressly incorporated herein by reference.

FIELD OF THE INVENTION

The present invention relates to an assembly of a buckle mechanism and blade, and a method of securing the blade to and releasing the blade from the buckle mechanism. More specifically, the present invention relates to a buckle mechanism having a locking surface, a movable guide, and a unitary biasing member.

BACKGROUND OF THE INVENTION

Existing buckle mechanisms have a moving lock member that secures a blade. These known buckle mechanisms are very complex devices comprised of a plethora of parts designed to engage and release the moving lock member from the blade to accomplish its relatively simple purpose. As a result of their complexity, known buckle mechanisms with a moving lock mechanism can be relatively expensive to manufacture and may be susceptible to failure.

One of the failures associated with these known buckle mechanisms is that releasing the blade from the buckle mechanism is difficult, if not impossible, after the assembly has withstood particular tensile forces. For example, vehicle passengers, after having been involved in an accident and restrained by a seat belt system employing a buckle mechanism with a moving lock, are unable to release the buckle mechanism. It is believed that the tensile forces applied to the moving lock member prevent the lock member from being moved in these conditions. Thus, a need exists for an assembly of a buckle mechanism and blade that has a minimum number of parts and avoids the difficulties of a moving lock member in a buckle mechanism.

SUMMARY OF THE INVENTION

Accordingly, the present invention is directed to an assembly of a buckle mechanism and blade, having a fastening surface, including a base, having a surface and a projection extending away from the surface, and a guide supported by the base. The projection has a lock surface substantially perpendicular to a plane passing through the surface of the base and contiguous to the surface. The guide engages the fastening surface of the blade with the lock surface of the projection.

In an alternative embodiment, the buckle mechanism and blade assembly includes a base within the housing, a guide supported by the base, and at least one biasing member within the housing. The biasing member locates the guide to a first position in which the blade engages the projection and opposes movement of the guide to a second position in which the blade disengages from the projection. The base has a surface and a projection extending away from the surface, and the guide locates the blade proximate the surface.

In a further embodiment, the invention includes a buckle mechanism having a base with a projection and a guide supported by the base. The guide has at least one wall defining a void and is positionable in a first position so that the projection occupies at least a portion of the void and a second position so that the projection is removed from the void.

The present invention also provides a method of securing a blade to a buckle mechanism. In this method, the buckle mechanism has a base and a guide supported by the base, the base has a projection providing a lock surface and a portion aligned with the lock surface. The guide is configured to support the blade, and the blade has a fastening surface and a support surface adjacent the fastening surface. This method includes: (1) inserting the blade into the guide; and (2) engaging the fastening surface of the blade with the lock surface of the projection and the support surface of the blade with the portion of the base aligned with the lock surface.

An alternative method of the present invention is a method of releasing a blade from a buckle mechanism, where the buckle mechanism has a base and a guide supported by the base. The base has a surface and a projection extending away from the surface. The projection provides a lock surface, and the guide is configured to support the blade. The blade has a fastening surface and a support surface adjacent the fastening surface. This method includes: (1) moving the fastening surface of the blade by the guide in a first direction substantially oblique to a plane passing through the surface of the base to disengage the fastening surface of the blade from the lock surface of the projection; and (2) removing the blade from the guide in a second direction substantially parallel to the surface of the base.

A further method of the present invention is a method of securing a blade to a buckle mechanism and releasing a blade from the buckle mechanism. The buckle mechanism has a base and a guide supported by the base. The base has a surface and a projection extending away from the surface, where the projection provides a lock surface. The guide is configured to support the blade, which has a fastening surface. This method includes: (1) inserting the blade into the guide; (2) engaging the fastening surface of the blade with the lock surface of the projection; (3) moving the fastening surface of the blade by the guide in a first direction substantially oblique to a plane passing through the surface of the base to disengage the fastening surface of the blade from the lock surface of the projection; and (4) removing the blade from the guide in a second direction substantially parallel to the surface of the base.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DESCRIPTION OF THE PREFERRED EMBODIMENTS

Figure 1:
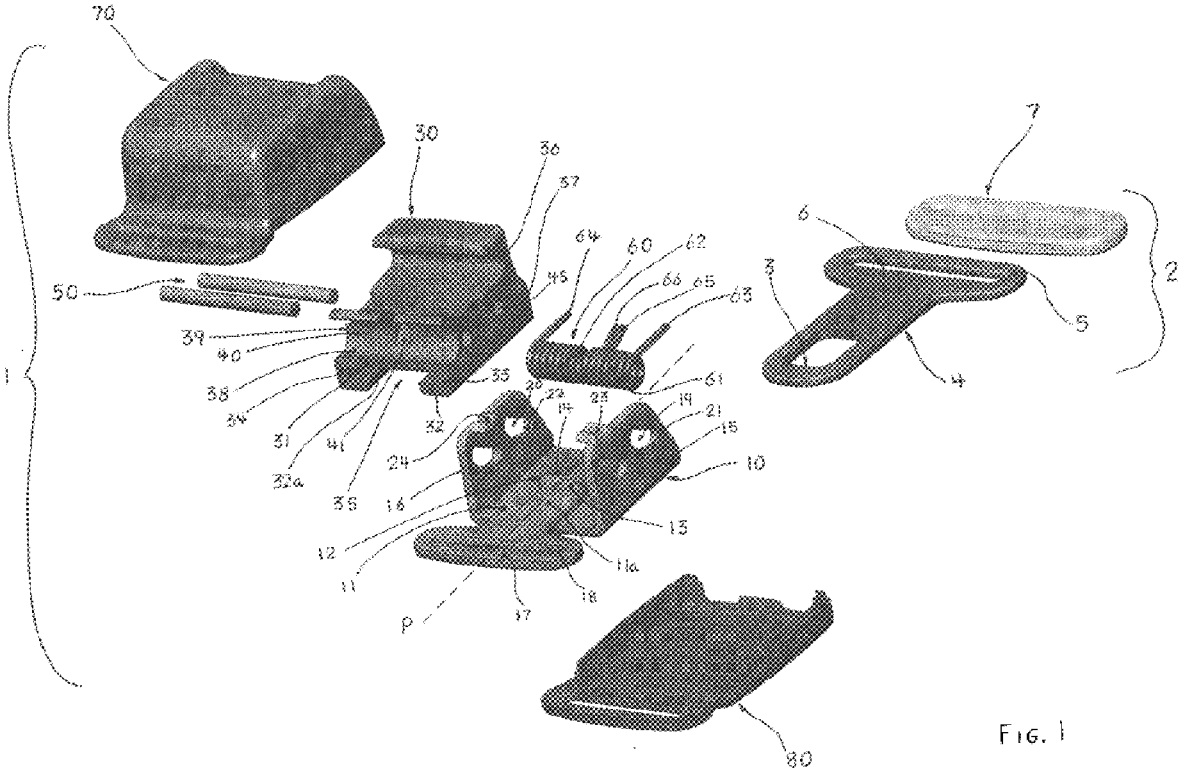
FIG. 1 is an exploded isometric view of the preferred embodiment of the assembly of the buckle mechanism and blade.

FIG. 1 illustrates a preferred embodiment of an assembly of a buckle mechanism 1 and blade 2. Blade 2 is operatively secured by buckle mechanism 1 to form the assembly. Blade 2 has a fastening surface 3, a support surface4 adjacent fastening surface 3, and a connecting portion 5 with a slit, or opening, 6. Preferably, blade 2 is a stamped metal member. A belt or web strapping (not shown) may be attached to the connecting portion 5 by the slit 6. A cover 7, preferably, surrounds the connection portion 5 to provide a desired appearance and/or to facilitate guidance of the belt. Cover 7 may be fabricated from plastic, metal, or other material with similar properties.

The buckle mechanism 1 includes a base 10, a guide 30, at least one guide pin 50, at least one biasing member 60, and a housing with an upper member 70 and a lower member 80. The base 10 has a surface 11 that includes at least one portion 11*a*, which is, preferably, substantially planar, and may include additional portions of surface 11, which are also, preferably, substantially planar. Although portions of surface 11 are preferably substantially planar, other configurations may be employed. For example, surface 11 may have concave or convex portions. Regardless of the configuration of surface 11, a projection 12 extends away from surface 11. As the location projection 12 extends away from surface 11, a plane P passes through the surface 11 to define a relationship between surface 11 and projection 12. In the preferred embodiment, the plane P passes through the portion 11*a* of surface 11. Projection 12 has a lock surface 13 substantially perpendicular to the plane P and contiguous to surface 11. Projection 12 also has a directional surface 14 oblique to the plane P passing through surface 11. The projection 12 is preferably-integrally formed on base 10, which fixes projection 12 within buckle mechanism 1. Preferably, base 10 is formed of metal, which is stamped and bent to form the preferred embodiment. Alternatively, base 10 may be formed from plastic, and in particular, injection molded plastic. However, those skilled in the art will recognize that base 10 can be formed with other methods and/or materials.

Base 10 includes a pair of side walls 15 and 16 projecting away from surface 11 and a connecting portion 17 with a slot, or opening, 18 that may be attached to a belt or web strapping (not shown). Connecting portion 17 extends from surface 11 and away from lock surface 13. In the preferred embodiment, the connection is contiguous with the portion 11*a* of surface 11. Side walls 15 and 16 are disposed on opposite sides of projection 12, are preferably mutually parallel, and are perpendicular to the plane P passing through portion 11*a* of surface 11. Each side wall 15 and 16 has at least one protrusion 23 and 24, respectively, projecting inward to projection 12. Each of side walls 15 and 16, respectively has at least one corresponding opening 19 and 20, respectively, with a curved surface 21 and 22.

Figure 2:
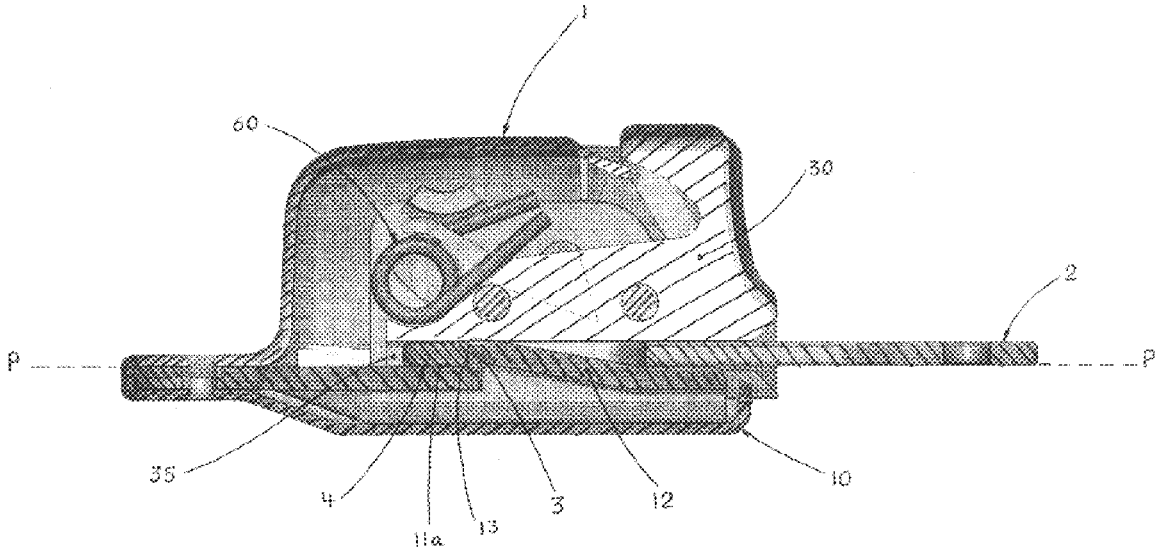
FIG. 2 is a cross-sectional view of the preferred embodiment of the assembly of the buckle mechanism and blade of FIG. 1 in a first (locked) position.

Guide 30 is supported by base 10. Guide 30 may be formed of any suitable material, however, guide member 30 is preferably formed from injection molded plastic. Guide 30 has at least one wall which defines a void 35. In the preferred embodiment, a first planar wall 31 and a second planar wall 32, offset by lateral walls 33 and 34, define void 35. Second planar wall 32 has a cut-out portion 32*a* that receives projection 12. Guide 30 also has at least one hole 45 that corresponds with the at least one opening 19 and 20 of each of the side walls 15 and 16. Guide 30 is operatively coupled to base 10 via at least one guide pin 50. Guide pin 50 is coupled to guide 30 and interfaces with openings 19 and 20. Hole 45 receives pin 50 such that pin 50 protrudes out of the at least one opening 19 and 20 of each of the side walls 15 and 16. Preferably, hole 45 extends through the entire width of guide 30 to accommodate a single pin 50. Alternatively, holes 45 may extend only through a portion of guide 30, in which case multiple pins 50 would be employed. Preferably, holes 45 are of sufficient diameter to loosely receive pins 50. When blade 2 is secured to projection 12, guide 30 is in a first, or locked, position, as shown in FIG. 2, such that pins 50 are positioned at lower portion of curved surfaces 21 and 22. When guide 30 is moved to lift blade 2 off of projection 12 and unsecure blade 2 from projection 12, guide 30 is in an unlocked position, such that pins 50, and correspondingly guide 30, are positioned at an upper portion of curved surfaces 21 and 22.

Directional surface 14 and curved surfaces 21 and 22 are geometrically related. In particular, in the preferred embodiment, a line tangent to the radius of curvature of curved surfaces 21 and 22 has an angle greater than or equal to an angle between directional surface 14 and portion 11*a* of surface 11. As would be apparent, a variety of alternate curved surfaces may be employed. In particular, alternate curved surfaces may be formed in side walls 15 and 16 and/or guide 30 to achieve the desired geometric relationship to enhance the operation of securing blade 2 with projection 12.

A release surface 36 is disposed adjacent guide 30 at a first end 37 and a bias surface 38 at a second end 39 opposite first end 37. Preferably, release surface 36 includes a concave indentation and is integrally formed on first end 37 of guide 30. The concave indentation provides a release button for an operator. Bias surface 38 defines a recess 40 to receive biasing member 60 and operatively engages biasing member 60. Biasing member 60 preferably includes a pair of torsion springs 61 and 62. Each torsion spring 61 and 62 has an end 63 and 64, respectively, abutting the other torsion spring 62 and 61, respectively, and an arm 65 and 66, respectively, protruding outside of recess 40. Ends 63 and 64 contiguously engage protrusions 23 and 24, respectively, so that guide 30 is biased toward projection 12, in a first, or locked, position. At least one notch 41, located proximate a center of the recess 40, receives arms 65 and 66 abutting each other. Notch 41 may be V-shaped or any other shape that may accommodate arms 65 and 66.

Upper member 70 is located proximate release surface 36, and mates with lower member to provide the housing. The housing surrounds a portion of base 10 and guide 30. Upper member 70 also retains pins 50 in their respective holes 45.

FIG. 2 illustrates the assembly of buckle mechanism 1 and blade 2 in a first, or locked, position. To achieve the locked position, blade 2 is first inserted into guide 30, so that blade 2 is located in void 35. Then, fastening surface 3 of blade 2 engages with lock surface 13 of projection 12, while support surface 4 of blade 2 engages with surface 11*a* of surface 11 aligned with lock surface 13. As discussed above in the preferred embodiment, portion 11*a* of surface 11 is contiguous with lock surface 13. It should be understood, however, that in order to achieve the method of the preferred embodiment, support surface 4 of blade 2 preferably engages portion 11*a* of surface 11 aligned with lock surface 13 and disposed between the side walls 15 and 16. That is, a portion of the surface 11 that traverses the distance between the side walls 15 and 16 and is located near lock surface 13, but may be spaced from lock surface 13. Engagement of support surface 4 of blade 2 with portion 11*a* of surface 11 aligned with lock surface 13 provides structural rigidity for blade 2 when in the locked position. During engagement of support surface 4 of blade 2 with lock surface 13 of projection 12, projection 12 occupies at least a portion of void 35. Biasing member 60 maintains guide 30 in the first, or locked, position, while opposing movement of guide 30 to the second, or unlocked, position.

Figure 3:
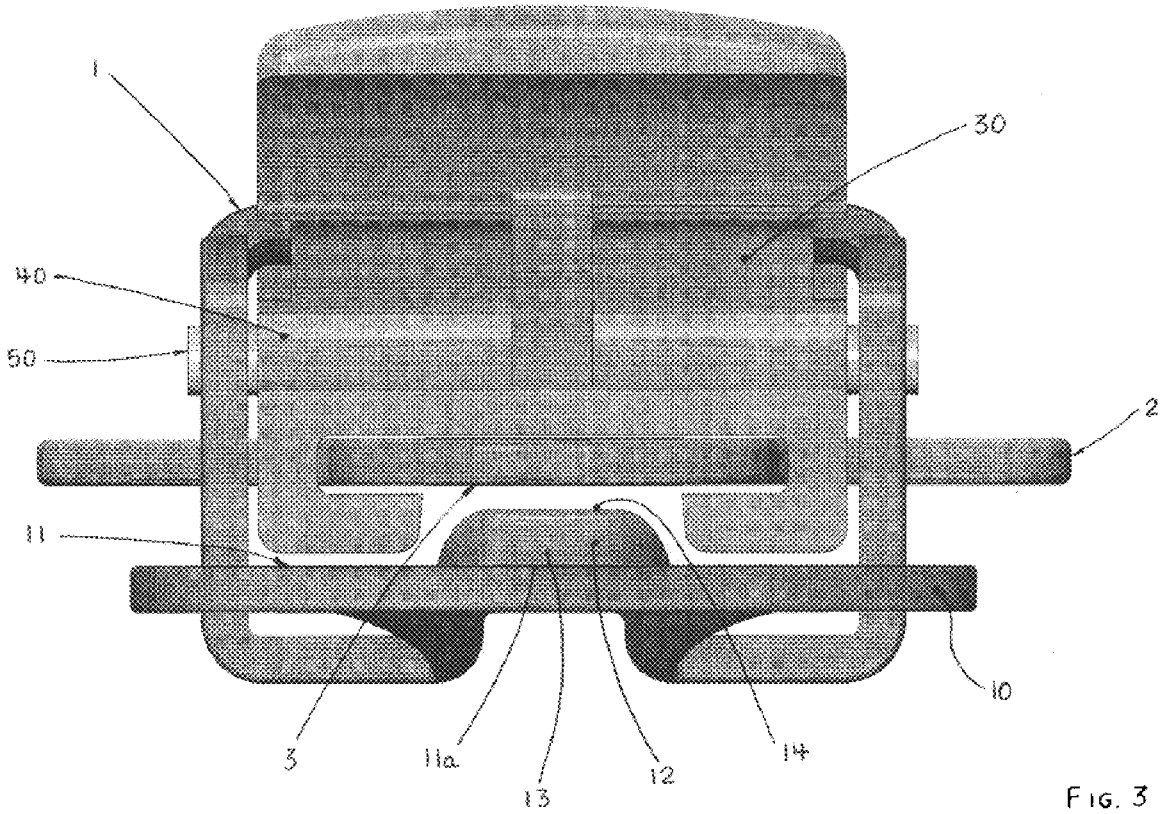
FIG. 3 is an end view of the assembly of the buckle mechanism and blade of FIG. 1 in a second (unlocked) position.

In order to place guide 30 in the second, or unlocked, position, as illustrated in FIG. 3, guide 30 is moved by an operator away from surface 11. Release surface 36 operates with guide 30 to assist the operator to move guide 30 away from surface 11. In particular, the fastening surface 3 of the blade 2 is moved in a first direction substantially oblique to the plane passing through surface 11 by applying force to release surface 36 of guide 30. In the preferred embodiment, fastening surface 3 of blade 2 is moved by guide 30 in a first direction substantially oblique to portion 11*a* of surface 11, which is planar. Guide 30 is moved to the second position, and blade 2 disengages from projection 12. Because of the movement of fastening surface 3 in the first direction to disengage blade 2 from projection 12, the applying force required on release surface 36 need be sufficient a force to overcome a frictional force between fastening surface 3 and lock surface 13 as guide 30 directs blade 2 off of projection 12. Thus, the effects of the tensile loading on the assembly of buckle mechanism 1 and blade 2 are minimized. Once the frictional force is overcome and guide 30 is in the second position, blade 2 is removed from guide 30 in a second direction substantially parallel to surface 11.

While the present invention has been illustrated in the drawings and briefly described with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. An assembly of a buckle mechanism and blade, the blade having a fastening surface, comprising:

a base having a surface and a projection extending away from the surface, the projection having a lock surface being substantially perpendicular to a plane passing through the surface and being contiguous to the surface;

a guide supported by the base, the guide engaging the fastening surface of the blade with the lock surface of the projection and including a release surface disposed at a first end of the guide and a bias surface at a second end of the guide, the second end being opposite the first end; and at least one biasing member, operatively engaging the second end of the guide, that locates the guide to a first position in which the fastening surface of the blade engages the lock surface of the projection and that opposes movement of the guide to a second position in which the blade disengages from the projection.

2. The assembly of claim 1 wherein the surface of the base comprises a planar surface.

3. The assembly of claim 2 wherein the projection of the base comprises a directional surface oblique to the planar surface.

4. The assembly of claim 1 wherein the release surface comprises a concave indentation.

5. The assembly of claim 1 further comprising a housing having an upper member proximate the release surface and a lower member engaging the upper member.

6. An assembly of a buckle mechanism and blade, the blade having a fastening surface, comprising:

a base having a surface and a projection extending away from the surface, the projection having a lock surface being substantially perpendicular to a plane passing through the surface and being contiguous to the surface; and a guide supported by the base, the guide engaging the fastening surface of the blade with the lock surface of the projection, and including at least one wall defining a void, the guide being positionable in a first position so that the projection occupies at least a portion of the void and a second position so that the projection is removed from the void.

7. The assembly of claim 6 wherein the at least one wall having a first planar wall and a second planar wall offset by at least one lateral wall, the second planar wall having a cut-out portion that receives the projection.

8. The assembly of 6 claim wherein the blade comprises a support surface and a connecting portion having a slit, the support surface being adjacent the fastening surface, the blade being slidably receivable within the void and releasably engageable with the projection.

9. An assembly of a buckle mechanism and blade, the blade having a fastening surface, comprising:

a base having a surface; a projection extending away from the surface, the projection having a lock surface being substantially perpendicular to a plane passing through the surface and being contiguous to the surface and a directional surface oblique to the planar surface; a pair of side walls projecting away from the surface, the projection located between the side walls, each of the side walls including at least one corresponding opening having a curved surface and a line tangent to the radius of curvature with an angle greater than or equal to an angle between the directional surface of the projection and the surface of the base; and a connection portion, having a slot, extending from the surface and away from the lock surface; and a guide supported by the base, the guide engaging the fastening surface of the blade with the lock surface of the projection.

10. The assembly of claim 9 wherein the guide comprises at least one portion defining a hole that corresponds with the at least one opening of each of the side walls and at least one guide pin, protruding out of the at least one opening of each of the side walls, coupled to the guide.

11. The assembly of claim 10 wherein each of the side walls comprise at least one protrusion that contiguously engages an end of the at least one biasing member.

12. A buckle mechanism and blade assembly comprising:

a housing;

a base within the housing, the base having a surface and a projection extending away from the surface;

a guide supported by the base, the guide locating the blade proximate the surface, and including a release surface disposed at a first end of the guide and a bias surface at a second end of the guide, the second end being opposite the first end, that operatively engages the at least one biasing member; and at least one biasing member locating the guide to a first position in which the blade engages the projection and opposing movement of the guide to a second position in which the blade disengages from the projection.

13. The assembly of claim 12 wherein the guide further comprises at least one wall defining a void, at least a portion of the void being occupied with the projection in the first position and the projection being removed from the void in the second position, the at least one wall having a first planar wall and a second planar wall offset by at least one lateral wall, the second planar wall having a cut-out portion that receives the projection.

14. The assembly of claim 12 wherein the housing comprises an upper member proximate the release surface and a lower member engaging the upper member.

15. The assembly of claim 12 wherein the bias surface defines a recess.

16. The assembly of claim 15 wherein the at least one biasing member is disposed within the recess.

17. The assembly of claim 16 wherein the at least one biasing member comprises a pair of torsion springs, each torsion spring having an end abutting the other torsion spring and an arm protruding outside of the recess.

18. The assembly of claim 17 wherein the arms of the springs contiguously engage at least one protrusion projecting inward to the projection from each of the side walls so that the guide is biased toward the projection.

19. The assembly of claim 18 wherein the guide comprises at least one notch, proximate a center of the recess, that receives the ends of the springs abutting each other.

20. A buckle mechanism and blade assembly comprising:

a housing;

a base within the housing, the base having a surface, a projection extending away from the surface, and a lock surface substantially perpendicular to the planar surface and being contiguous to the planar surface, a pair of side walls projecting away from the planar surface, and a connection portion, having a slot, extending from the planar surface and away from the lock surface, the projection being located between the pair of side walls;

a guide supported by the base, the guide locating the blade proximate the surface; and at least one biasing member locating the guide to a first position in which the blade engages the projection and opposing movement of the guide to a second position in which the blade disengages from the projection.

21. A buckle mechanism comprising:

a base having a projection; and a guide supported by the base, the guide having at least one wall defining a void, the guide being positionable in a first position so that the projection occupies at least a portion of the void and a second position so that the projection is removed from the void.

22. The buckle mechanism of claim 21 wherein the at least one wall comprises a first planar wall and a second planar wall offset from the first planar wall by at least one lateral wall, the second planar wall having a cut-out portion that receives the projection.

23. The buckle mechanism of claim 21 further comprising at least one biasing member that locates the guide to the first position and that opposes movement of the guide to the second position.

24. The buckle mechanism of claim 23 wherein the guide comprises a release surface disposed at a first end of the guide and a bias surface at a second end of the guide, the second end being opposite the first end, that operatively engages the at least one biasing member.

25. The buckle mechanism of claim 24 wherein the release surface comprises a concave indentation.

26. The buckle mechanism of claim 23 wherein the base comprises a substantially planar surface and a lock surface substantially perpendicular to the planar surface and being contiguous to the planar surface.

27. The buckle mechanism of claim 26 wherein the projection extends away from the planar surface and has a directional surface oblique to the planar surface.

28. The buckle mechanism of claim 26 wherein the base comprises a pair of side walls projecting away from the planar surface and a connection portion, having a slot, extending from the planar surface and away from the lock surface, the projection being located between the pair of side walls.

29. The buckle mechanism of claim 28 wherein the side walls comprises at least one protrusion that contiguously engages an end of the at least one biasing member.

* * * * *